US009765464B2

(12) United States Patent
Hettinger et al.

(10) Patent No.: US 9,765,464 B2
(45) Date of Patent: Sep. 19, 2017

(54) WASHING MACHINE APPLIANCE

(71) Applicant: General Electric Company, Schenectady, NY (US)

(72) Inventors: Stephen Edward Hettinger, Louisville, KY (US); Ryan Ellis Leonard, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 245 days.

(21) Appl. No.: 14/602,596

(22) Filed: Jan. 22, 2015

(65) Prior Publication Data

US 2016/0215429 A1 Jul. 28, 2016

(51) Int. Cl.

| | |
|---|---|
| ***D06F 33/02*** | (2006.01) |
| ***D06F 39/00*** | (2006.01) |
| *D06F 37/20* | (2006.01) |

(52) U.S. Cl.

CPC ..... *D06F 33/02* (2013.01); *D06F 39/003* (2013.01); *D06F 37/203* (2013.01); *D06F 2202/10* (2013.01); *D06F 2204/086* (2013.01); *D06F 2220/00* (2013.01)

(58) Field of Classification Search

CPC .. D06F 39/002; D06F 39/087; D06F 2202/10; D06F 33/02; D06F 37/203

USPC ..... 68/12.04, 12.05, 12.06; 8/158

See application file for complete search history.

(56) References Cited

U.S. PATENT DOCUMENTS

| | | | | |
|---|---|---|---|---|
| 4,862,710 | A | 9/1989 | Torita et al. | |
| 5,130,624 | A * | 7/1992 | Bashark | D06F 58/28 318/280 |
| 5,275,025 | A | 1/1994 | Nakamura et al. | |
| 5,669,250 | A | 9/1997 | Dausch et al. | |
| 5,768,728 | A | 6/1998 | Harwood et al. | |
| 2004/0154645 | A1 * | 8/2004 | Kim | D06F 39/087 134/18 |
| 2015/0121630 | A1 * | 5/2015 | Lee | D06F 37/306 8/137 |

FOREIGN PATENT DOCUMENTS

WO 2011010518 A1 1/2011

* cited by examiner

*Primary Examiner* — Michael Wieczorek
*Assistant Examiner* — Kevin G Lee
(74) *Attorney, Agent, or Firm* — Dority & Manning, P.A.

(57) ABSTRACT

A method for washing articles in a wash chamber of the washing machine appliance is provided. The method includes receiving user input of a user-selected water fill amount for a wash cycle, the user-selected water fill amount being the largest water fill amount available for selection by a user. The method also includes determining a characteristic of a load of the washing machine appliance and determining that an amount of water associated with the user-selected water fill amount is inadequate for the load. In response, the method includes providing the wash chamber of the washing machine appliance with an amount of water greater than an amount associated with the user-selected water fill amount.

16 Claims, 3 Drawing Sheets

WASHING MACHINE APPLIANCE

FIELD OF THE INVENTION

The present subject matter relates generally to washing machine appliances and methods for operating the same.

BACKGROUND OF THE INVENTION

Washing machine appliances generally include a tub for containing wash fluid, e.g., water and detergent, bleach, and/or other wash additives. A basket is rotatably mounted within the tub and defines a wash chamber for receipt of articles for washing. During normal operation of such washing machine appliances, wash fluid is directed into the tub to a fill amount and onto articles within the wash chamber of the basket. The basket or an agitation element can rotate at various speeds to agitate articles within the wash chamber in the wash fluid, to wring wash fluid from articles within the wash chamber, etc.

Certain washing machine appliances allow for user selection of the wash fluid fill amount of the washing machine appliance. For example, the washing machine appliance may allow for a user to select, e.g., a small fill amount, a medium fill amount, or a large fill amount. Each of the small, medium, and large fill amounts correspond to a certain amount of wash fluid. The ability to select a water fill amount is a generally commercially desirable feature.

However, with relatively large loads, it may be easy for certain consumers to overestimate an amount of water or wash fluid necessary to wash such a load of laundry. Overestimating the amount of water or wash fluid necessary may lead to energy inefficiencies. Accordingly, a method for operating a washing machine appliance capable of allowing a user to select a desired water fill amount, while still including one or more features to improve an energy efficiency of the washing machine appliance would be useful.

BRIEF DESCRIPTION OF THE INVENTION

Aspects and advantages of the invention will be set forth in part in the following description, or may be apparent from the description, or may be learned through practice of the invention.

In an exemplary aspect, a method is provided of washing articles in a wash chamber of a washing machine appliance. The method includes receiving a user input of a user-selected water fill amount for a wash cycle of the washing machine appliance, the user-selected water fill amount being the largest water fill amount available for selection by a user. The method also includes determining a characteristic of a load in the wash chamber of the washing machine appliance and determining that an amount of water associated with the user-selected water fill amount is inadequate for the load in the wash chamber based on the determined characteristic of the load in the wash chamber. The method further includes providing the wash chamber of the washing machine appliance with an amount of water greater than the amount associated with the user-selected water fill amount.

In an exemplary embodiment, a washing machine appliance is provided. The washing machine appliance includes a tub and a basket positioned within the tub. The basket is rotatable within the tub and defines a wash chamber for receipt of articles for washing. The washing machine appliance also includes a controller configured to receive a user input of a user-selected water fill amount for a wash cycle of the washing machine appliance, the user-selected water fill amount being the largest water fill amount available for selection by a user. The controller is also configured to determine a characteristic of a load in the wash chamber of the washing machine appliance and determine that an amount of water associated with the user-selected water fill amount is inadequate for the load in the wash chamber based on the determined characteristic of the load in the wash chamber. The controller is further configured to provide the wash chamber with an amount of water greater than the amount of water associated with the user-selected water fill amount with the flow regulator.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
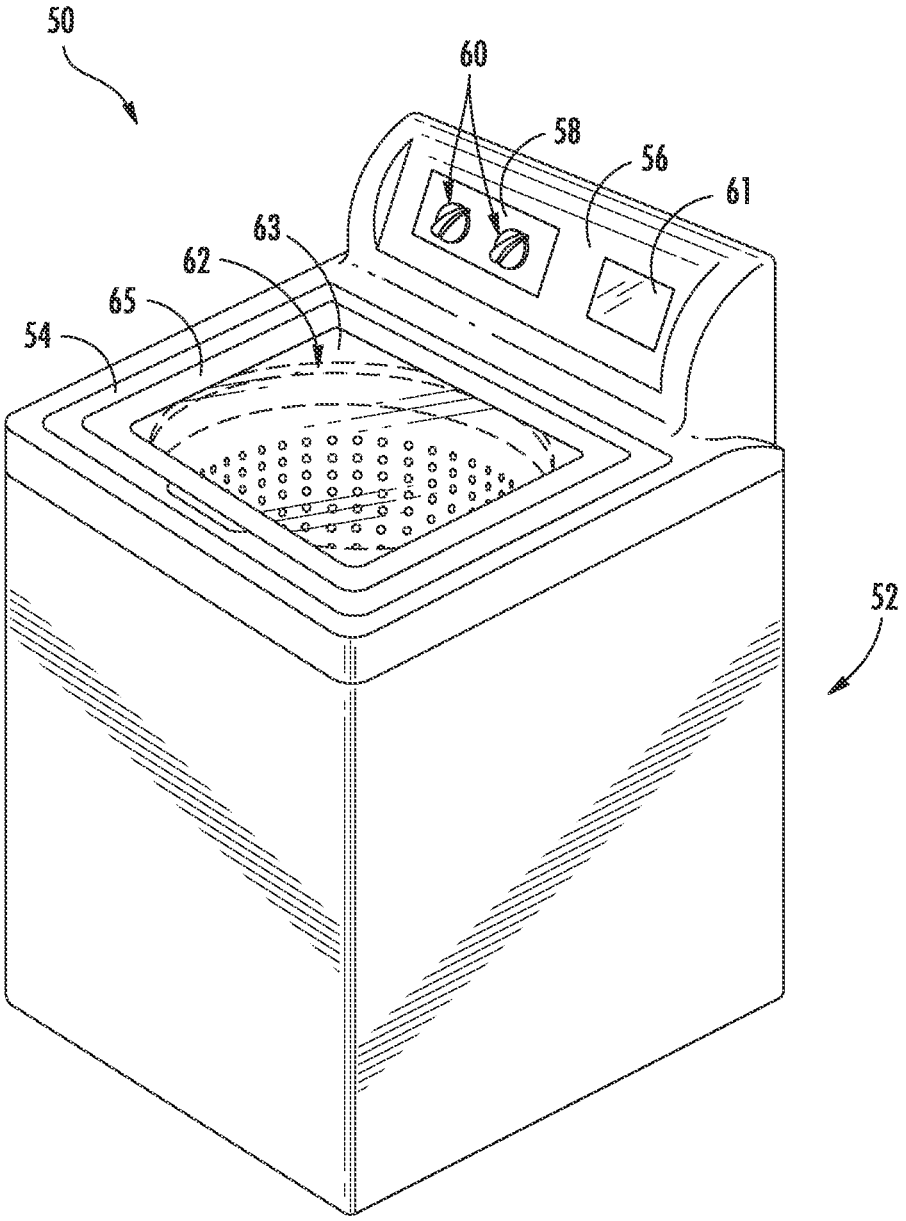
FIG. 1 provides a perspective view of a washing machine appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of a washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58, including a plurality of input selectors 60, is coupled to backsplash 56. At least one of the input selectors 60 is a water fill amount selector capable of allowing a user to manually select a desired water fill amount. As used herein, the term "water fill amount" may refer to the amount of water provided during e.g., a wash cycle and/or a rinse cycle of the washing machine appliance 50. Additionally, or alternatively, however, in other embodiments, "water fill amount" may instead refer to a level or height to which the water is filled during, e.g., a wash cycle and/or a rinse cycle of the washing machine appliance 50.

Control panel 58 and input selectors 60 collectively form a user interface input for operator selection of machine cycles and features, and in one embodiment, a display 61 indicates selected features, a countdown timer, and/or other items of interest to machine users. It should be appreciated, however, that in other exemplary embodiments, the control panel 58, input selectors 60, and display 61, may have any other suitable configuration. For example, in other exemplary embodiments, one or more of the input selectors 60 may be configured as manual "push-button" input selectors, or alternatively may be configured as a touchscreen on, e.g., display 61.

A lid 62 is mounted to cover 54 and is rotatable between an open position (not shown) facilitating access to a wash tub 64 (FIG. 2) located within cabinet 52 and a closed position (shown in FIG. 1) forming an enclosure over tub 64. Lid 62 in exemplary embodiment includes a transparent panel 63, which may be formed of, for example, glass, plastic, or any other suitable material. The transparency of the panel 63 allows users to see through the panel 63, and into the tub 64 when the lid 62 is in the closed position. In some embodiments, the panel 63 may itself generally form the lid 62. In other embodiments, the lid 62 may include the panel 63 and a frame 65 surrounding and encasing the panel 63. Alternatively, panel 63 need not be transparent.

Figure 2:
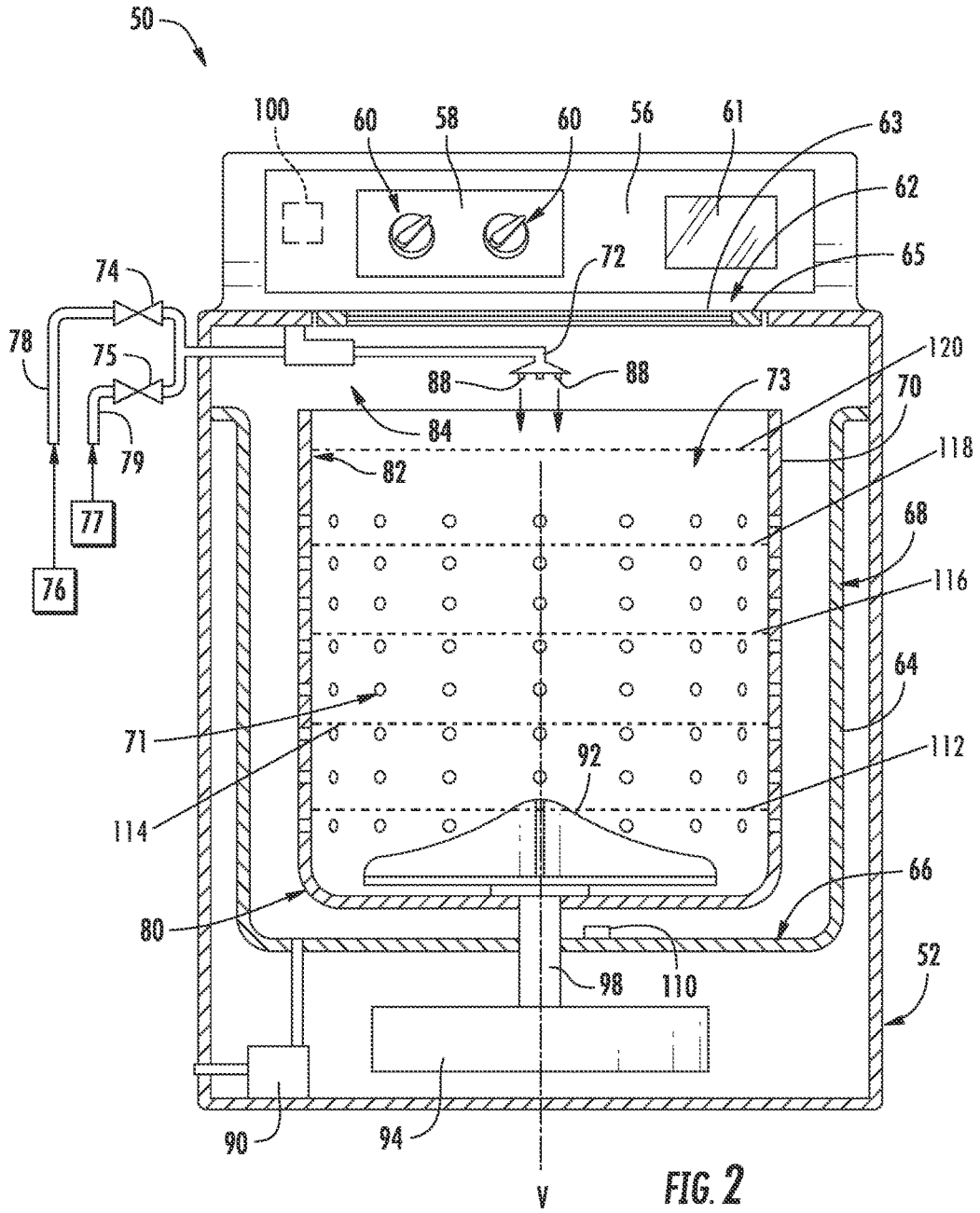
FIG. 2 provides a front, section view of the exemplary washing machine appliance of FIG. 1.

FIG. 2 provides a front, cross-section view of the exemplary washing machine appliance 50 of FIG. 1. As may be seen in FIG. 2, tub 64 includes a bottom wall 66 and a sidewall 68. A wash drum or wash basket 70 is rotatably mounted within tub 64. In particular, basket 70 is rotatable about a vertical axis V. Thus, washing machine appliance is generally referred to as a vertical axis washing machine appliance. Basket 70 defines a wash chamber 73 for receipt of articles for washing and extends, e.g., vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent to top portion 82 of basket 70. Nozzle 72 may be in fluid communication with one or more water sources 76, 77 in order to direct liquid (e.g. water) into tub 64 and/or onto articles within chamber 73 of basket 70. Nozzle 72 may further include apertures 88 through which water may be sprayed into the tub 64. Apertures 88 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed, i.e. sprayed or poured, into the tub 64.

Various valves may regulate the flow of fluid through nozzle 72. For example, a flow regulator may be provided to control a flow of hot and/or cold water into the wash chamber of washing machine appliance 50. For the embodiment depicted, the flow regulator includes a hot water valve 74 and a cold water valve 75. The hot and cold water valves 74, 75 are utilized to flow hot water and cold water, respectively, therethrough. Each valve 74, 75 can selectively adjust to a closed position in order to terminate or obstruct the flow of fluid therethrough to nozzle 72. The hot water valve 74 may be in fluid communication with a hot water source 76, which may be external to the washing machine appliance 50. The cold water valve 75 may be in fluid communication with a cold water source 77, which may be external to the washing machine appliance 50. The cold water source 77 may, for example, be a commercial water supply, while the hot water source 76 may be, for example, a water heater. Such water sources 76, 77 may supply water to the appliance 50 through the respective valves 74, 75. A hot water conduit 78 and a cold water conduit 79 may supply hot and cold water, respectively, from the sources 76, 77 through the respective valves 74, 75 and to the nozzle 72.

Moreover, as is shown, the exemplary washing machine appliance defines a plurality of water-fill amounts. At least certain of the water fill amounts may be selected by a user using, e.g., one of input selectors 60. For example, the washing machine appliance 50 may define at least three user-selectable water fill amounts. More particularly, for the embodiment depicted, the exemplary washing machine appliance 50 defines at least four user-selectable water fill amounts—a small water fill amount 112, a medium-low water fill amount 114, a medium-high water fill amount 116, and a large water fill amount 118. Additionally, for the embodiment depicted, the washing machine appliance 50 also defines a maximum water fill amount 120, which may not be user-selectable. Accordingly, the large water-fill amount 118 is the largest water fill amount available for selection by a user.

An amount of water associated with the maximum water fill amount 120 is greater than an amount of water associated with the largest water fill amount available for selection by a user, i.e., the large water-fill amount 118. The amount of water associated with the maximum water fill amount 120 may be the maximum amount of water the washing machine appliance 50 is capable of handling. It should be appreciated, however, that in other exemplary embodiments, the washing machine appliance 50 may instead define any other suitable number of user selectable water fill amounts, and/or additional water fill amounts between the large water-fill amount 118 in the maximum water fill amount 120.

An additive dispenser 84 may additionally be provided for directing a wash additive, such as detergent, bleach, liquid fabric softener, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. For the embodiment depicted, nozzle 72 is a separate downstream component from dispenser 84. In other exemplary embodiments, however, nozzle 72 and dispenser 84 may be integral, with a portion of dispenser 84 serving as the nozzle 72, or alternatively dispenser 84 may be in fluid communication with only one of hot water valve 74 or cold water valve 75. In still other exemplary embodiments, the washing machine appliance 50 may not include a dispenser, in which case a user may add one or more wash additives directly to wash chamber 73. A pump assembly 90 (shown schematically in FIG. 2) is located beneath tub 64 and basket 70 for gravity assisted flow to drain tub 64.

An agitation element 92, shown as an impeller in FIG. 2, may be disposed in basket 70 to impart an oscillatory motion to articles and liquid in chamber 73 of basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 92 is oriented to rotate about vertical axis V. Basket 70 and agitation element 92 are driven by a motor 94, such as a pancake motor. As motor output shaft 98 is rotated, basket 70 and agitation element 92 are operated for rotatable movement within tub 64, e.g., about vertical axis V. It should be appreciated, however, that in other exemplary embodiments, the exemplary washing machine appliance 50 may not include an agitation element 92, and instead washing machine appliance 50 may agitate articles positioned within wash chamber 73 by, e.g., rotating basket 70. Washing machine appliance 50 may also include a brake assembly (not shown) selectively applied or released for respectively maintaining basket 70 in a stationary position within tub 64 or for allowing basket 70 to spin within tub 64.

Various sensors may additionally be included in the washing machine appliance 50. For example, a pressure sensor 110 may be positioned in the tub 64 as illustrated or, alternatively, may be remotely mounted in another location within the appliance 50 and be operationally connected to tub 64 by a hose (not shown). Any suitable pressure sensor 110, such as an electronic sensor, a manometer, or another suitable gauge or sensor, may be utilized. The pressure sensor 110 may generally measure the pressure of water in the tub 64. This pressure can then be utilized to estimate the height or amount of water in the tub 64. Additionally, a suitable speed sensor can be connected to the motor 94, such as to the output shaft 98 thereof, to measure speed and indicate operation of the motor 94. Other suitable sensors, such as temperature sensors, water/moisture sensors, etc., may additionally be provided in the washing machine appliance 50.

Operation of washing machine appliance 50 is controlled by a processing device or controller 100, that is operatively coupled to the input selectors 60 located on washing machine backsplash 56 (shown in FIG. 1) for user manipulation to select washing machine cycles and features. Controller 100 may further be operatively coupled to various other components of appliance 50, such as the flow regulator (including valves 74, 75), motor 94, pressure sensor 110, other suitable sensors, etc. In response to user manipulation of the input selectors 60, controller 100 may operate the various components of washing machine appliance 50 to execute selected machine cycles and features.

Controller 100 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 may be in communication with controller 100 via one or more signal lines or shared communication busses.

While described in the context of specific embodiments of washing machine appliance 50, using the teachings disclosed herein it will be understood that washing machine appliance 50 is provided by way of example only. Other washing machine appliances having different configurations (such as horizontal-axis washing machine appliances), different appearances, and/or different features may also be utilized with the present subject matter as well.

Figure 3:
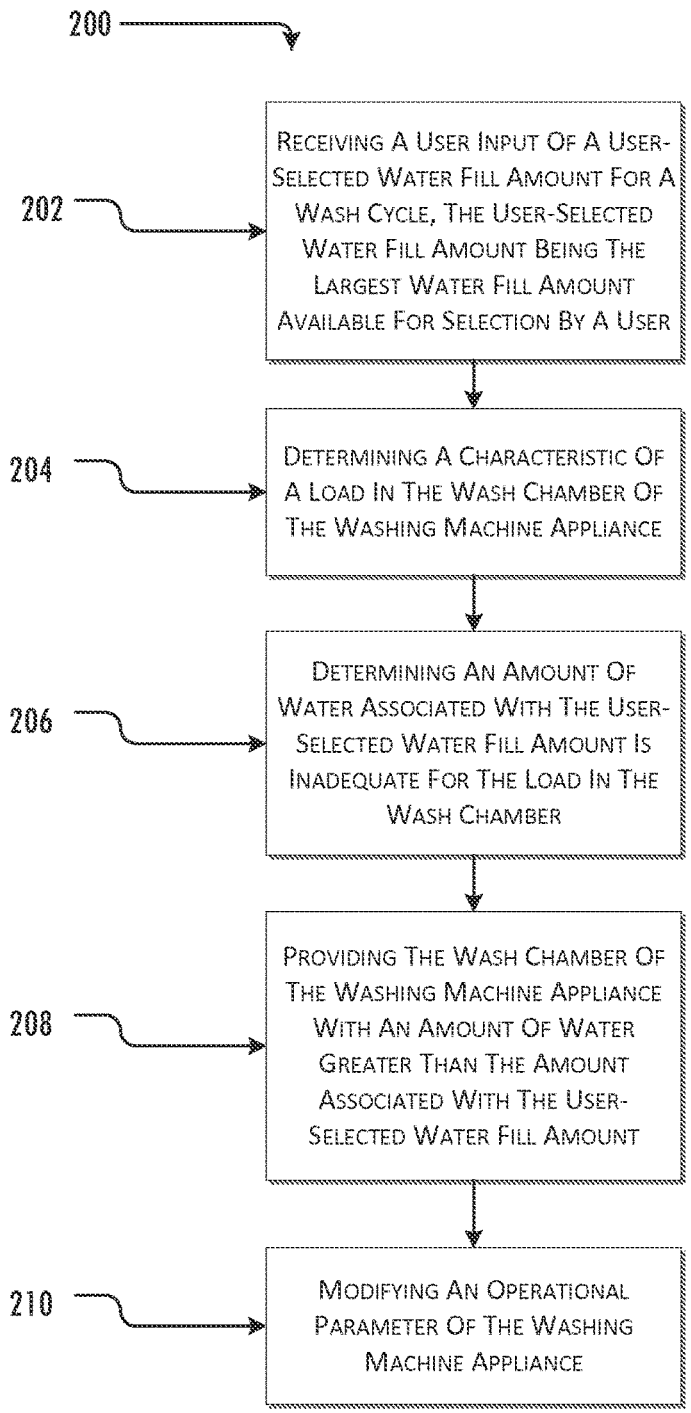
FIG. 3 provides a flow chart of a method in accordance with an exemplary aspect of the present disclosure.

Referring now to FIG. 3, a flow chart of a method (200) for operating a washing machine appliance in accordance with an exemplary aspect of the present disclosure is provided. More particularly, FIG. 3 provides a flow chart of an exemplary method (200) of washing articles in a wash chamber of a washing machine appliance. In certain exemplary aspects, the exemplary method (200) may be used in conjunction with the exemplary washing machine appliance 50 described above with reference to FIGS. 1 and 2.

As is depicted, the exemplary method (200) includes at (202) receiving a user input of a user-selected water fill amount for a wash cycle of the washing machine appliance. For the exemplary aspect depicted and described herein, the user-selected water fill amount is the largest water fill amount available for selection by a user. In certain exemplary aspects, receiving a user input at (202) of a user-selected water fill amount may include receiving a user input with one or more input selectors, such as rotary dials, push buttons, or one or more touch screen inputs. Alternatively, however, any other suitable means or method may be used for receiving a user input at (202).

Additionally, although not depicted in FIG. 3, the exemplary method (200) may additionally include other aspects associated with the washing of articles in the washing machine. For example, the method (200) may include providing the wash chamber of the washing machine appliance with the one or more articles to be washed (i.e., a load), selecting certain other parameters of the wash cycle (e.g., a temperature of the water/wash fluid, a soil level, etc.), and initiating the wash cycle.

Referring still to FIG. 3, the exemplary method (200) additionally includes at (204) determining a characteristic of a load in the wash chamber of the washing machine appliance. In certain exemplary aspects, the characteristic of the load in the wash chamber of the washing machine appliance may include a size of the load. Additionally, or alternatively, characteristic of the load in the wash chamber of the washing machine appliance may include an absorption of the load, or more particularly, an absorption of the one or more articles for washing in the load. For example, determining a characteristic of a load in the wash chamber the washing machine appliance at (204) may include performing a load detection algorithm on the load before, or soon after, a user initiates the wash cycle of the washing machine appliance. In certain exemplary aspects, performing a load detection algorithm may include performing a wet load sensing method to detect an absorbency of the load, performing a dry load sensing method (using, e.g., inertial spinning), or performing any other load detection method or combination of load detection methods to determine the characteristic of the load at (204).

Moreover, the exemplary method (200) includes at (206) determining that an amount of water associated with the user-selected water fill amount is inadequate for the load in the wash chamber based on the determined characteristic of the load in the wash chamber at (204). For example, a user may have provided the wash chamber with a relatively large load and/or with a relatively absorbent load. In such an exemplary aspect, the amount of water associated with the largest water fill amount available for selection by a user may be inadequate to, e.g., fully saturate such a load.

Accordingly, the exemplary method (200) additionally includes at (208) providing the wash chamber of the washing machine appliance with an amount of water greater than the amount associated with the user-selected water fill amount (i.e., the largest water fill amount available for selection by a user). Providing the additional amount of water at (208) may be in response to the characteristic of the load determined at (204) and/or the determination made at (206) that the amount of water associated with the user-selected water fill amount is inadequate for the load in the wash chamber.

For example, in certain exemplary aspects, the washing machine appliance may define a maximum water fill amount, an amount of water associated with the maximum water fill amount being greater than an amount of water associated with the largest water fill amount available for selection by a user. In such an exemplary aspect, providing the wash chamber of the washing machine appliance at (208) with an amount of water greater than the amount associated with the user-selected water fill amount may include providing the wash chamber of the washing machine appliance with the amount of water associated with the maximum water fill amount.

In other exemplary aspects, however, the washing machine appliance may additionally define one or more water fill amounts between the largest water fill amount available for selection and the maximum water fill amount. In such an exemplary aspect, providing the wash chamber of the washing machine appliance at (208) with an amount of water greater than the amount of water associated with the user-selected water fill amount may further include determining an appropriate water fill amount greater than the largest water fill amount available for selection by a user. Moreover, such an exemplary aspect may additionally include providing the wash chamber of the washing machine appliance with such an amount of water associated with the fill amount determined to be appropriate.

Referring still to FIG. 3, the exemplary method (200) further includes at (210) modifying an operational parameter of the washing machine appliance. Modifying an operational parameter at (210) may be in response to determining at (206) the amount of water provided in the user-selected water fill amount is inadequate for the loading the wash chamber the washing machine appliance and/or providing at (208) the wash chamber the washing machine appliance with an amount of water greater than the amount associated with the user-selected water fill amount.

In certain exemplary aspects, for example, modifying the operational parameter at (210) of the washing machine appliance may include modifying one or both of an intensity of an agitation phase of the wash cycle and a stroke length of an agitation element or the wash basket (e.g., if no agitation element is present) of the washing machine appliance. Additionally, or alternatively, in other exemplary aspects, modifying the operational parameter at (210) of the washing machine appliance may include modifying a wash time of the wash cycle. However, in other exemplary aspects, any other additional or alternative operational parameters may also be modified as appropriate.

It should be appreciated, however, that the modification of the user-selected water fill amount only applies to the situation above (i.e., where a characteristic of the load indicates that the amount of water associated with the largest user selectable water fill amount would be inadequate for the load). For example, in alternatives of the exemplary method (200) not depicted in FIG. 3, selection of a small water fill amount results in providing the wash chamber the washing machine appliance with an amount of water equal to the amount associated with the small water fill amount. Similarly, in other alternatives of the exemplary method (200) not depicted in FIG. 3, selection of a medium-low water fill amount results in providing the wash chamber of the washing machine appliance with amount of water equal to an amount associated with the medium-low water fill amount. Further, in other alternatives of the exemplary method (200) not depicted in FIG. 3, selection of a medium-high water fill amount results in providing the wash chamber of the washing machine appliance with amount of water equal to an amount associated with the medium-high water fill amount.

More particularly, for subsequent wash cycles, the exemplary method (200) may additionally include receiving a user input of a user-selected water fill amount, the user input being the small water fill amount, the medium-low water fill amount, or the medium-high water fill amount. In such an exemplary aspect, the exemplary method (200) would include providing the wash chamber the washing machine appliance with an amount of water associated with the small water fill amount, the medium-low water fill amount, or the medium-high water fill amount, respectively, regardless of any determined characteristics of the load in the wash chamber of the washing machine appliance.

The exemplary method (200) described above with reference to FIG. 3 may provide a user or consumer with a desired amount of autonomy in performing one or more wash cycles with the washing machine appliance. However, the exemplary method (200) described above with reference to FIG. 3 may also prevent a user from repeatedly selecting a water fill amount larger than necessary for large loads, while at the same time, still allow the washing machine appliance to be provided with an appropriate amount of water for relatively large and/or relatively absorbent loads. Accordingly, such an exemplary method (200) may improve an energy efficiency of the washing machine appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of washing articles in a wash chamber of a washing machine appliance, the method comprising:

receiving a user input of a user-selected water fill amount for a wash cycle of the washing machine appliance, there being at least a small water fill amount, a medium water fill amount, and a large water fill amount, the user-selected water fill amount being the large water fill amount, the large water fill amount being the largest water fill amount available for selection by a user;

determining a characteristic of a load in the wash chamber of the washing machine appliance;

determining that an amount of water associated with the user-selected water fill amount is inadequate for the load in the wash chamber based on the determined characteristic of the load in the wash chamber; and providing the wash chamber of the washing machine appliance with an amount of water greater than the amount associated with the user-selected water fill amount;

wherein regardless of any determined characteristics of the load of the washing machine appliance, selection of the small water fill amount results in providing the wash chamber of the washing machine appliance with an amount of water equal to an amount associated with the small water fill amount, and selection of the medium water fill amount results in providing the wash chamber of the washing machine appliance with an amount of water equal to an amount associated with the medium water fill amount.

2. The method of claim 1, wherein the characteristic of the load in the wash chamber of the washing machine appliance includes a size of the load.

3. The method of claim 2, wherein the characteristic of the load in the wash chamber of the washing machine appliance additionally includes an absorption of the load.

4. The method of claim 1, wherein the washing machine appliance defines a maximum water fill amount, an amount of water associated with the maximum water fill amount being greater than an amount of water associated with the largest water fill amount available for selection by a user, and wherein providing the wash chamber of the washing machine appliance with an amount of water greater than the amount associated with the user-selected water fill amount includes providing the wash chamber of the washing machine appliance with the amount of water associated with the maximum water fill amount.

5. The method of claim 1, wherein the washing machine appliance defines a maximum water fill amount, an amount of water associated with the maximum water fill amount being greater than an amount of water associated with the largest water fill amount available for selection by a user, wherein the washing machine appliance defines one or more water fill amounts between the largest water fill amount available for selection and the maximum water fill amount, and wherein providing the wash chamber of the washing machine appliance with an amount of water greater than the amount associated with the user-selected water fill amount includes determining an appropriate water fill amount greater than the largest water fill amount available for selection by a user.

6. The method of claim 1, further comprising modifying an operational parameter of the washing machine appliance in response to determining the amount of water provided by the user-selected water fill amount is inadequate for the load in the wash chamber of the washing machine appliance.

7. The method of claim 6, wherein modifying the operational parameter of the washing machine appliance includes modifying one or both of an intensity of an agitation phase and a stoke length of an agitation element.

8. The method of claim 6, wherein modifying the operational parameter of the washing machine appliance includes modifying a wash time of the wash cycle.

9. A washing machine appliance comprising a tub;

a basket positioned within the tub, the basket rotatable within the tub and defining a wash chamber for receipt of articles for washing; and a controller configured to receive a user input of a user-selected water fill amount for a wash cycle of the washing machine appliance, there being at least a small water fill amount, a medium water fill amount, and a large water fill amount, the user-selected water fill amount being the large water fill amount, the large water fill amount being the largest water fill amount available for selection by a user;

determine a characteristic of a load in the wash chamber of the washing machine appliance;

determine that an amount of water associated with the user-selected water fill amount is inadequate for the load in the wash chamber based on the determined characteristic of the load in the wash chamber; and provide the wash chamber with an amount of water greater than the amount of water associated with the user-selected water fill amount;

wherein regardless of any determined characteristics of the load of the washing machine appliance, selection of the small water fill amount results in providing the wash chamber of the washing machine appliance with an amount of water equal to an amount associated with the small water fill amount, and selection of the medium water fill amount results in providing the wash chamber of the washing machine appliance with an amount of water equal to an amount associated with the medium water fill amount.

10. The washing machine appliance of claim 9, wherein the characteristic of the load in the wash chamber of the washing machine appliance includes a size of the load.

11. The washing machine appliance of claim 10, wherein the characteristic of the load in the wash chamber of the washing machine appliance further includes an absorption of the load.

12. The washing machine appliance of claim 9, wherein the washing machine appliance defines a maximum water fill amount, an amount of water associated with the maximum water fill amount being greater than an amount of water associated with the largest water fill amount available for selection by a user, and wherein in providing the wash chamber of the washing machine appliance with an amount of water greater than the amount associated with the user-selected water fill amount, the controller is configured to provide the wash chamber of the washing machine appliance with the amount of water associated with the maximum water fill amount.

13. The washing machine appliance of claim 9, wherein the washing machine appliance defines a maximum water fill amount, an amount of water associated with the maximum water fill amount being greater than an amount of water associated with the largest water fill amount available for selection by a user, wherein the washing machine appliance defines one or more water fill amounts between the largest water fill amount available for selection and the maximum water fill amount, and wherein in providing the wash chamber of the washing machine appliance with an amount of water greater than the amount associated with the user-selected water fill amount, the controller is configured to determine an appropriate water fill amount greater than the largest water fill amount available for selection by a user.

14. The washing machine appliance of claim 9, wherein the controller is further configured to modify an operational parameter of the washing machine appliance in response to determining the amount of water provided by the user-selected water fill amount is inadequate for the load in the wash chamber.

15. The washing machine appliance of claim 14, wherein in modifying the operational parameter of the washing machine appliance, the controller is configured to modify one or both of an intensity of an agitation phase and a stoke length of an agitation element.

16. The washing machine appliance of claim 14, wherein in modifying the operational parameter of the washing machine appliance, the controller is configured to modify a wash time of the wash cycle.

* * * * *